US011166356B2

(12) United States Patent
Mishra et al.

(10) Patent No.: US 11,166,356 B2
(45) Date of Patent: Nov. 2, 2021

(54) CONSTANT CURRENT DRIVER CHARGING ENERGY STORAGE UNIT

(71) Applicant: SIGNIFY HOLDING B.V., Eindhoven (NL)

(72) Inventors: Priya Ranjan Mishra, Eindhoven (NL); Matthias Wendt, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/962,061

(22) PCT Filed: Jan. 15, 2019

(86) PCT No.: PCT/EP2019/050846

§ 371 (c)(1),
(2) Date: Jul. 14, 2020

(87) PCT Pub. No.: WO2019/141638

PCT Pub. Date: Jul. 25, 2019

(65) Prior Publication Data

US 2020/0396810 A1 Dec. 17, 2020

(30) Foreign Application Priority Data

Jan. 18, 2018 (IN) ..... 201841002090
May 3, 2018 (EP) ..... 18159846

(51) Int. Cl.
*H05B 45/37* (2020.01)
*H05B 45/345* (2020.01)
(Continued)

(52) U.S. Cl.
CPC ..... *H05B 45/37* (2020.01); *H05B 45/325* (2020.01); *H05B 45/345* (2020.01);
(Continued)

(58) Field of Classification Search
CPC .. H05B 45/345; H05B 45/10; H05B 45/3725; H05B 45/37; H05B 47/165
See application file for complete search history.

(56) References Cited

U.S. PATENT DOCUMENTS

2006/0171180 A1* 8/2006 Kyono ..... H02M 3/33592 363/95
2013/0154491 A1* 6/2013 Hawley ..... H05B 45/44 315/200 R (Continued)

FOREIGN PATENT DOCUMENTS

EP 2544511 A1 1/2013

*Primary Examiner* — Raymond R Chai

(57) ABSTRACT

The present invention relates to a functional device (10) powered by a constant current driver (12). The device (10) comprises constant current driver (12), electrical energy storage unit (14), functional unit (16), and control unit (18). The device (10) is controlled by the control unit (18) such that the constant current driver (12) provides a constant current to the functional unit (16) and the storage unit (14) in dependence of a pulse width modulated voltage signal. Current is provided to the storage unit (14) for charging the storage unit (14) during at least part of off periods of the pulse width modulated voltage signal. During on periods of the pulse width modulated voltage signal, current is provided to the functional unit (16) and no current is provided to the storage unit (14). This allows providing the device with a constant current driver with less idle periods and lower current supply.

12 Claims, 5 Drawing Sheets

(51) Int. Cl.

| | |
|---|---|
| ***H05B 45/325*** | (2020.01) |
| ***H05B 47/165*** | (2020.01) |
| ***H05B 45/10*** | (2020.01) |
| ***H05B 45/3725*** | (2020.01) |

(52) U.S. Cl.
CPC ..... *H05B 47/165* (2020.01); *H05B 45/10* (2020.01); *H05B 45/3725* (2020.01)

(56) References Cited

U.S. PATENT DOCUMENTS

| | | | | |
|---|---|---|---|---|
| 2014/0361623 | A1* | 12/2014 | Siessegger ..... | H02M 7/06 307/64 |
| 2015/0108908 | A1* | 4/2015 | Denvir ..... | H05B 45/50 315/186 |
| 2017/0317516 | A1* | 11/2017 | Stern ..... | G03B 21/2033 |

* cited by examiner

CONSTANT CURRENT DRIVER CHARGING ENERGY STORAGE UNIT

CROSS-REFERENCE TO PRIOR APPLICATIONS

This application is the U.S. National Phase application under 35 U.S.C. § 371 of International Application No. PCT/EP2019/050846, filed on Jan. 15, 2019, which claims the benefit of European Patent Application No. 18159846.7, filed on Mar. 5, 2018 and Indian Patent Application No. 201841002090, filed on Jan. 18, 2018. These applications are hereby incorporated by reference herein.

FIELD OF THE INVENTION

The present invention relates to a functional device, a functional system, a method for operating the functional device, a computer program for operating the functional device and a computer-readable medium storing the computer program. The functional device can for example be a lighting device comprising a light emitting diode (LED), a heating device comprising a heating element, an actuation device comprising an actuation element, an audio amplifier device or any other functional device provided with current from a constant current driver.

BACKGROUND OF THE INVENTION

An LED has a forward voltage, i.e. an amount of volts the LED requires to conduct electricity and light up, changing with temperature. If a constant voltage is applied to the LED, the temperature of the LED increases and the forward voltage of the LED decreases. This causes the LED to draw more current, leading to a circle of decreasing forward voltage and increasing current drawing in which finally the LED has a temperature that destroys it. Therefore LED drivers are used in order to provide a constant current by varying the drive voltage provided to the LED.

US 2013/0154491 A1 shows a dimmable LED illumination system with an LED driver, a current sink, an LED, and an output capacitor. The LED driver is coupled to receive a DC power supply and a dimming control and generates a drive voltage and a current control according to the dimming control. The current sink is coupled to receive the current control and controls an LED current through the LED to a substantially direct current during an active duration and an inactive duration. The LED driver can operate in a moderate brightness mode in which during the active duration, an output current generated by the LED driver is split to LED current provided to the LED and charging current that charges the output capacitor and in which the output current is disabled during the inactive duration. Charges accumulated on the output capacitor in the active duration are discharged in the inactive duration to provide a supplemental current as LED current. This allows the dimmable LED illumination system to maintain a preferred driver efficiency during the active duration.

US 2015/0108908 A1 discloses a system for driving a multi-color solid state light source luminaire so as to maintain a color point as temperature varies within a given range. An array of solid-state light sources includes two or more strings and is driven by a single constant current source. The amount of current that flows in these strings may be adjusted as temperature changes. In one such current-sharing scenario, the duty cycle of a switching control signal corresponds directly to the proportion of current that flows in one of two distinct strings of solid-state light sources.

SUMMARY OF THE INVENTION

It can be seen as an object of the present invention to provide a functional device, a functional system, a method for operating the functional device, and a computer program for operating the functional device which require a lower current supply.

In a first aspect of the present invention a functional device is presented. The functional device comprises a constant current driver, an electrical energy storage unit, a functional unit, and a control unit. The constant current driver is configured for providing a constant current by varying a drive voltage. The electrical energy storage unit is configured for storing electrical energy. The functional unit is configured to perform a function and to receive current from the constant current driver and the electrical energy storage unit. The control unit is configured for controlling a flow of the current to and from the electrical energy storage unit and to the functional unit. The control unit is configured to provide a pulse width modulated (PWM) voltage signal for controlling the flow of the current such that current is provided to the electrical energy storage unit in order to charge the electrical energy storage unit during at least a part of off periods of the PWM voltage signal and such that current is provided to the functional unit and no current is provided to the electrical energy storage unit during on periods of the PWM voltage signal.

Since the control unit is configured to provide a PWM voltage signal for controlling the flow of the current such that current is provided to the electrical energy storage unit in order to charge the electrical energy storage unit during at least a part of off periods of the PWM voltage signal and such that current is provided to the functional unit and no current is provided to the electrical energy storage unit in on periods of the PWM voltage signal, the current provided by the constant current driver is either provided to the functional unit or to the electrical energy storage unit. This allows reducing required current supply as not both the functional unit and the electrical energy storage unit have to be provided with current at the same time. Hence a constant current driver with lower current supply can be used in the functional device. Furthermore the use of the constant current driver can be improved, as it can have less periods in which it is not used.

As the functional unit is configured to receive current from the constant current driver and the electrical energy storage unit, the functional unit can be provided with current from the constant current driver, from the electrical energy storage unit or simultaneously from the constant current driver and the electrical energy storage unit.

The constant current driver generates the drive voltage and the constant current in dependence of the PWM voltage signal provided by the control unit. The constant current driver functions as current source to power the functional unit and to charge the electrical energy storage unit. The constant current driver can be configured to be connected to a current source or the constant current driver can comprise a current source.

The constant current driver can comprise a current regulation unit, a clock generator, an output voltage sensing unit, a switching regulator, a rectifier, and a filter or any combination of these. The constant current driver can for example be an LED driver or the like, in particular a known LED driver as for example the one known from FIG. 3*a* of US 2013/0154491 A1 and described in the corresponding description, which is incorporated herein by reference. The clock generator can for example be configured to generate an AC drive voltage. The current regulation unit can be configured to receive a constant current driver control signal, e.g. an analog or digital dimming control signal, from the control unit that depends on the PWM voltage signal and which is used for controlling the constant current driver. The current regulation unit can furthermore be configured to generate a current control signal, a first critical voltage, and a second critical voltage with the second critical voltage being smaller than the first critical voltage. The first and second critical voltages define an output voltage range for the drive voltage which is varied in order to provide a constant current. In order to drive a functional unit in form of an LED, the second critical voltage is determined according to the lowest conduction voltage of the LED. The output voltage sensing unit can be configured to compare the AC drive voltage generated by the clock generator to the critical voltages and to generate a duration control signal that determines active durations in which the constant current driver provides a constant current and inactive durations in which the constant current driver does not provide a constant current. The switching regulator can be configured to modulate the AC drive voltage generated by the clock generator according to the duration control signal and the constant current driver control signal. The rectifier is configured to rectify the modulated drive voltage signal and the filter is configured to filter the modulated drive voltage signal in order to generate the drive voltage. In contrast to the operation of known LED drivers, such as the one presented in US 2013/0154491 A1, the constant current driver of the functional device has less durations in which no constant current is provided, as constant current can be provided to the electrical energy storage unit during at least part of the off periods of the PWM voltage signal. Hence, while a known LED driver can be used in the functional device, the LED driver works in a different manner that allows to reduce idle periods of the LED driver. Furthermore the control unit can be configured to alter PWM voltage signals based on sensing an output current of the constant current driver.

The electrical energy storage unit can for example be a battery, a capacitor or any other device that allows storing electrical energy provided as current.

The functional unit can for example be a lighting element, a heating element, an actuation element, an audio amplifier or any other functional unit operating on current provided by a constant current driver. The lighting element can for example be an LED, an LED array or any other lighting element that generates light when it is provided with constant current. The actuation element can for example be a piezoelectric actuator, electromagnetic actuator, a DC electric motor or any other actuation element.

The control unit can for example comprise integrated circuitry, a processor, or any other unit for processing data.

The PWM voltage signal has a duty cycle and a frequency. The frequency defines how fast the PWM completes a cycle, e.g., 1 Hz corresponds to 1 cycle per second. The frequency can for example have a value in the range between 200 Hz and 1000 Hz. The duty cycle is defined as the proportion of time in which the signal is in an on state, i.e., the proportion of on period of the PWM voltage signal. The on state is defined as a state in which the amplitude of the PWM voltage signal is higher compared to an off state, i.e. an off period of the PWM voltage signal. The amplitude in the on state of the PWM voltage signal can for example be above 5 V, such as 12 V. In the off state the amplitude of the PWM voltage signal is lower than in the on state, and can for example be 0 V. The control unit can be configured to control the frequency and duty cycle of the PWM voltage signal in order to control a switching of the constant current driver such that it either provides the functional unit with electrical energy or charges the electrical energy storage unit. This allows providing a constant current to the functional unit and the energy storage unit during operation of the functional device.

The functional device allows revenue benefits and cost reductions as services like demand response (DR) or demand side management (DSM) may be used with the functional device. DR regards a short term increase of electrical energy price on the electrical energy market which encourages users to reduce demand for electrical energy in response. DSM regards encouraging users to be more energy efficient. The functional device may require less electrical components which allows to reduce electromagnetic interference (EMI) and electromagnetic compatibility (EMC) issues as well as harmonization issues. The functional device may be less complex leading to less cost and an increased mean time between failures (MTBF).

The electrical storage unit and the functional unit can be connected in parallel. This connection arrangement allows the control unit to control the flow of the current such that current is provided to the electrical energy storage unit in order to charge the electrical energy storage unit during at least a part of the off periods of the PWM voltage signal and such that current is provided to the functional unit and no current is provided to the electrical energy storage unit during the on periods of the PWM voltage signal.

The control unit can be configured for controlling the flow of current by switching the constant current driver such that the constant current driver provides current either to the electrical energy storage unit or the functional unit based on the PWM voltage signal. The functional device can comprise an electrical circuit with switching units that can be configured to be controlled by the PWM voltage signal generated by the control unit such that current is provided to the electrical energy storage unit in order to charge the electrical energy storage unit during at least a part of the off periods of the PWM voltage signal and such that current is provided to the functional unit and no current is provided to the electrical energy storage unit during the on periods of the PWM voltage signal.

Alternatively or additionally the control unit can be configured to control a charging rate of the electrical energy storage unit by regulating a deadband period between on periods of the PWM voltage signal and charging periods of the off periods of the PWM voltage signal in which current is provided to the electrical energy storage unit. The deadband period can be between on period and charging period, between two charging periods in the off period or between charging period and on period.

The functional device can comprise a deadband controller. The deadband controller can be configured to control the charging rate of the electrical energy storage unit. The deadband controller can be part of the control unit. The deadband controller can be configured to control the charging rate of the electrical energy storage unit by regulating the deadband period between on periods of the PWM voltage signal and the charging periods of the off periods of the PWM voltage signal. This allows to lower the dependence of the charging rate on the duty cycle of the PWM voltage signal. The deadband period can be varied from zero to a full PWM off period. This allows flexible control of the charging of the electrical energy storage unit.

The deadband controller can be configured to control charging such that constant current constant voltage (CCCV) requirements, trickle charge requirements or both CCCV requirements and trickle charge requirements are fulfilled. In the CCCV charging regime the electrical energy storage unit is charged with a constant current in a first phase. This allows limiting the maximal current in contrast to loading with constant voltage. A second phase of the CCCV charging regime starts when the electrical energy storage unit reaches a predetermined voltage. In the second phase of the CCCV charging regime the electrical energy storage unit is charged with a constant voltage. This allows to reduce the current provided to the electrical energy storage unit in order to avoid overcharging. In the trickle charging regime a fully charged electrical energy storage unit is charged by providing current at a self discharge rate of the electrical energy storage unit under no load. This allows the electrical energy storage unit to remain at full charge.

The functional unit can comprise an LED. The functional unit can also comprise more than one LED, e.g., two LEDs, or an LED array. Alternatively or additionally the functional unit can comprise another lighting element, a heating element, an actuation element, an audio amplifier or any other functional unit operating on current provided by a constant current driver. The constant current driver can be an LED driver. If the functional unit comprises an LED or LED array and the constant current driver is an LED driver the control unit can be configured for controlling a dimming of the LED by switching the LED driver based on the PWM voltage signal. This allows better control of dimming and a higher light efficiency in addition of charging the electrical energy storage unit by using the constant current driver in form of the LED driver.

The electrical energy storage unit can be configured to provide current to the functional unit during on periods of the PWM voltage signal. This allows improving the efficiency of the functional device. Furthermore a constant current driver with less current supply can be provided as the functional unit is provided with current of both the constant current driver and the electrical energy storage unit. If the functional unit comprises an LED the current provided to the functional unit can be used by the functional unit to power the LED and therefore to provide light.

Alternatively or additionally the electrical energy storage unit can be configured to provide current to the functional unit during at least part of the off periods of the PWM voltage signal.

The device can be configured to operate in an intelligent pulse width modulated (IPWM) mode. The device can for example comprise an additional current source arranged between the energy storage unit and the functional unit and the device can be configured to activate the additional current source only during off periods of the PWM voltage signal. The device can be configured to enable an IPWM operation. In IPWM mode the additional current source can be configured to control a level of analog current during the off periods of the PWM voltage signal. The current provided by the constant current driver and the analog current can be superimposed during on periods and provided to the functional unit, i.e. the constant current driver can be configured to provide the current and the analog current during on periods of the PWM voltage signal. The additional current source can be configured to control providing current from the electrical energy storage unit to the functional unit during a failure of the constant current driver, DR or DSM time. In this case the electrical energy storage unit is not provided with current from the constant current driver, as the constant current driver is not in operation and the electrical energy storage unit is configured to provide a constant current to the functional unit based on a drive voltage provided by the additional current source arranged between the energy storage unit and the functional unit. In case that the functional unit comprises an LED or LED array, this allows better color and light intensity control and thus efficient light intensity. IPWM operation of the device with a functional unit comprising an LED can be easily allowed by adding an additional current source in between the electrical energy storage unit and the LED during off periods of the PWM voltage signal.

The constant current driver can be configured for providing a low output current. The low output current is sufficiently high to power the functional unit but does not allow charging the energy storage unit simultaneously. Low output current can for example be in the range between 100 mA and 2000 mA, such as between 100 mA and 1100 mA, such as between 100 mA and 300 mA. This allows to provide a power supply with less power and thus increases flexibility in designing the device.

The constant current driver can be configured to provide an output voltage between 8 V and 60 V, for example between 27 V and 54 V.

The control unit can comprise a buck converter, a boost converter, and/or a linear converter, i.e., the control unit can comprise a buck converter, a boost converter, a linear converter or any combination of them.

The control unit can be configured for controlling a value of constant current provided by the constant current driver, e.g. the LED driver.

The control unit can be configured to provide an analog signal, e.g., an analog control signal. The analog control signal can for example be used for controlling the constant current driver and/or a value of constant current provided by the constant current driver.

The functional device can for example be a battery integrated luminaire for emergency lighting or a networked battery integrated luminaire.

In a further aspect of the present invention a functional system is presented. The functional system comprises the device according to one of the claims 1 to 10 or any embodiment of the functional device. The functional system furthermore comprises a current source. The current source can be a current source external to the functional device or the current source can be part of the functional device.

The functional system can comprise a network control unit, for example a building management system (BMS), that is configured for controlling the control unit. The network control unit can be configured to generate a control signal for controlling the functional device. For example in case that the functional unit is an LED, the control signal can be a control signal for controlling a dimming level of the LED through PWM voltage signals and/or for controlling a charging rate of the electrical energy storage unit. Additionally or alternatively the network control unit can comprise a transceiver for receiving a control signal. The control signal can for example be provided by a user via wireless or wired network connection. The user may for example provide the control signal by a computer or a mobile device such as a mobile phone.

In a further aspect of the present invention a method for operating the functional device according to claim 1 or any embodiment of the functional device is presented. The method comprises the steps:

providing a PWM voltage signal for switching the constant current driver in order to control the flow of current, controlling the flow of current such that current is provided to the electrical energy storage unit in order to charge the electrical energy storage unit during at least a part of off periods of the PWM voltage signal and such that current is provided to the functional unit and no current is provided to the electrical energy storage unit during on periods of the PWM voltage signal.

The flow of current can be controlled by switching the constant current driver such that the constant current driver provides current either to the electrical energy storage unit or the functional unit based on the PWM voltage signal.

The method can comprise the step:

regulating a deadband period between on periods of the PWM voltage signal and charging periods of the off periods of the PWM voltage signal in which current is provided to the electrical energy storage unit in order to control a charging rate of the electrical energy storage unit.

In case that the functional device comprises a lighting element, such as an LED or LED array, the method can comprise the step:

switching the constant current driver based on the PWM voltage signal in order to control a dimming of the lighting element.

The method can comprise the step:

providing current from the electrical energy storage unit to the functional unit during on periods of the PWM voltage signal.

Alternatively or additionally the method can comprise the step:

providing current from the electrical energy storage unit to the functional unit during at least part of the off periods of the PWM voltage signal.

The method can be operated in an IPWM mode or comprise a step:

operating the functional device in an IPWM mode.

In a further aspect of the present invention a computer program for operating the functional device according to claim 1 or any embodiment of the functional device is presented. The computer program comprises program code means for causing a processor to carry out the method as defined in claim 12 or any embodiment of the method, when the computer program is run on the processor.

In a further aspect of the present invention a computer program for operating the functional system according to claim 11 or any embodiment of the functional system is presented. The computer program comprises program code means for causing a processor to carry out the method as defined in claim 12 or any embodiment of the method, when the computer program is run on the processor.

In a further aspect of the present invention a computer-readable medium having stored the computer program of claim 14 is presented. Alternatively or additionally the computer-readable medium can have the computer program according to any embodiment of the computer program stored.

It shall be understood that the functional device of claim 1, the functional system of claim 11, the method of claim 12, the computer program of claim 14, and the computer readable medium of claim 15 have similar and/or identical preferred embodiments, in particular, as defined in the dependent claims.

It shall be understood that a preferred embodiment of the present invention can also be any combination of the dependent claims or above embodiments with the respective independent claim.

These and other aspects of the invention will be apparent from and elucidated with reference to the embodiments described hereinafter.

DETAILED DESCRIPTION OF EMBODIMENTS

Figure 1:
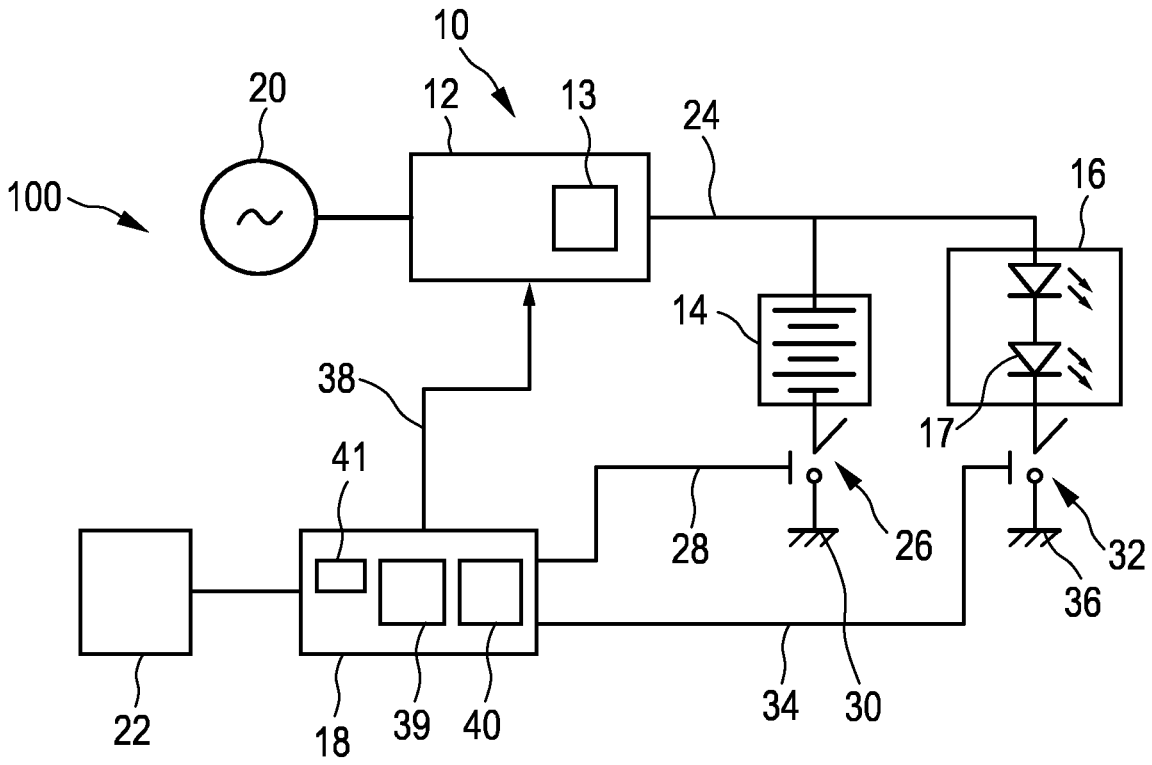
FIG. 1 shows schematically and exemplarily a first embodiment of a functional device in form of a lighting device in a first embodiment of a functional system in form of a lighting system.

FIG. 1 shows schematically and exemplarily a first embodiment of a functional device in form of a lighting device 10 in a first embodiment of a functional system in form of a lighting system 100. In other embodiments the functional device can be a heating device, an actuation device, an audio amplifier device, or any other functional device operating based on current provided by a constant current driver. The functional system can therefore in other embodiments be a heating system, an actuation system, a car, an audio system or any other functional system with a device operating based on current provided by a constant current driver.

The lighting device 10 comprises a constant current driver in form of an LED driver 12, an electrical energy storage unit in form of a battery 14, a functional unit in form of an LED module 16, and a control unit 18.

In other embodiments an alternative constant current driver, electrical energy storage unit, and functional unit may be provided. The electrical energy storage unit may for example be a capacitor, such as an electrolytic capacitor, or supercapacitor, or an array of capacitors and/or batteries. The functional unit may for example be a heating element, an actuation element, an audio amplifier or any other functional unit that can be operated by a current provided by a constant current driver. The actuation element can for example be a piezoelectric actuator, electromagnetic actuator, a DC electric motor or any other actuation element.

The lighting device 10 is connected with an AC current source 20 and a network control unit in form of a BMS 22. The AC current source 20 is connected to the LED driver 12 and the BMS 22 is connected to the control unit 18. In this embodiment the AC current source 20 is AC mains power supply. In other embodiments the functional device is connected to a DC current source or comprises a DC current source or AC current source. In other embodiments the BMS can be replaced by another network control unit. The network control unit can also be part of the functional system or the functional device in other embodiments.

The LED driver 12 comprises an AC/DC converter 13 and is connected via a common bus 24 with the battery 14 and the LED module 16. The battery 14 and the LED module 16 are connected in parallel. The AC/DC converter 13 converts AC provided by the AC source 20 to DC. The DC can be used in the lighting device 10.

The battery 14 is connected via battery switching unit 26 to common 30. The battery switching unit 26 can be switched to connect the battery 14 to common 30 based on a charging control signal provided via wire 28. In other embodiments the switching unit 26 can be switched based on the charging control signal provided wirelessly from the control unit 18 (not shown). Common 30 is connected to the common of control unit 18 (not shown). In alternative embodiments common 30 can also be optically isolated.

The LED module 16 is connected via LED module switching unit 32 to common 36. The LED module switching unit 32 can be switched to connect LED module 16 to common 36 based on a dimming control signal provided via wire 32. In other embodiments the switching unit 32 can be switched based on the dimming control signal provided wirelessly from the control unit 18 (not shown). In this embodiment common 36 is optically isolated from common 30.

The control unit 18 is connected to the LED driver 12 via wire 38. The control unit 18 can switch the LED driver 12 by closing the circuit via battery switching unit 26 or LED module switching unit 32 such that the LED driver 12 provides current either to the battery 14 or to the LED module 16. If the circuit is closed via battery switching unit 26, the battery 14 can be charged. If the circuit is closed via LED module switching unit 32, the LED module 16 can be operated. In this embodiment either the circuit is closed via the battery switching unit 26 or via the LED module switching unit 32.

The LED driver 12 provides a constant current by varying a drive voltage. In this embodiment the LED driver 12 is a Philips 40 W 0.10-1.1 A 54V SR XI040C110V054PT1 that has an output voltage range between 27 V and 54 V. This allows providing various types of LED modules with current and charging the battery 14 with a wide voltage range. The LED driver 12 can provide a constant current between 100 mA and 1100 mA in this embodiment. In other embodiments the Philips 40 W 0.10-1.1 A 54V SR XI040C110V054PT1 can be replaced by any other LED driver or constant current driver. In other embodiments the output voltage range which can be used for the drive voltage can be different. The output voltage range can for example be between 8 V and 60 V.

The battery 14 stores electrical energy provided by the current. The battery 14 can provide current to the control unit 18 and thus can power the control unit 18 via common 30 and common of the control unit 18 if the circuit is closed via the battery switching unit 26. The battery 14 is rechargeable.

The LED module 16 comprises two LEDs 17 in this embodiment. In other embodiments the LED module can comprise an LED array of more than two LEDs, for example 3, 4, 6, 8, 10, 12 or more LEDs. The LED module 16 can receive a constant current from the LED driver 12 and provide it to the LEDs 17 in order for the LEDs 17 to generate light if the circuit is closed via the LED module switching unit 32.

The control unit 18 comprises a processor 39, a deadband controller 40, and a computer-readable medium in form of a memory 41. The control unit 18 generates PWM voltage signals for controlling a dimming of the LEDs 17 of the LED module 16. PWM voltage signals have a voltage amplitude, duty cycle and frequency (see FIG. 2) that are controlled by the control unit 18 in order to control dimming of the LEDs 17 of the LED module 16. The control unit 18 controls the flow of current using a PWM voltage signal. Therefore in this embodiment the control unit 18 switches the switching units 26 and 32 based on the charging control signal and the dimming control signal which are generated in dependence of the PWM voltage signal such that current is provided to the battery 14 in order to charge the battery 14 during at least a part of off periods of the PWM voltage signal and such that current is provided to the LED module 16 and no current is provided to the battery 14 during on periods of the PWM voltage signal.

Thus the LED module 16 and the battery 14 are both alternatingly powered in a constant current mode. The battery 14 can be charged at various charging rates. This allows considering DR and DSM. Additionally the battery 14 can be used to provide current to the control unit 18 in order to obtain revenue and cost benefits by DR and DSM. In other embodiments the battery 14 can be used to provide current to other units of the functional device, such as the functional unit.

The control unit 18 in this embodiment furthermore provides a value for the constant current to the LED driver 12. The value for the constant current can be included in an analog dimming signal which is generated in dependence of the PWM voltage signal and provided to the LED driver 12 via wire 38 in order to control the LED driver 12 and to change the value of the constant current provided by the LED driver 12. This allows an increased flexibility.

In this embodiment the deadband controller 40 controls the charging rate of the battery 14 by regulating a deadband period between on periods of the PWM voltage signal and charging periods of the off periods of the PWM voltage signal in which current is provided to the battery 14. Therefore the deadband controller 40 provides a deadband signal to the switching unit 26 which prevents the switching unit 26 to switch in order to connect the battery 14 with common 30 during the deadband period. Hence during the deadband period none of the circuits closeable by switching units 26 and 32 is closed such that no current flows during the deadband period. The deadband controller 40 can control the duration of the deadband period between 0% and 100% of the off period of the PWM voltage signal, such that the battery 14 is charged only during a part of the off period of the PWM voltage signal. This allows to reduce the charging rate compared to the charging rate which would be achieved by using the whole off period of the PWM voltage signal for charging the battery 14. Therefore the charging rate flexibility is increased. For large enough off periods, i.e., at a certain dimming level, the charging rate can become independent of the duty cycle. The deadband controller 40 in this embodiment regulates the deadband period such that CCCV and trickle charge requirements are fulfilled.

In this embodiment the BMS 22 provides a control signal to the control unit 18 which sets a dimming level of the LED module 16 and a charging rate for the battery 14. The BMS 22 is in this embodiment controlled by a user which enters specific values for dimming level and charging rate. In other embodiments the dimming level and/or charging rate can be automatically selected in dependence of certain parameters, such as daytime, brightness, current electrical energy market price, or any other parameter that is relevant for determining the dimming level of the LED module 16 and/or charging rate of the battery 14.

The control unit 18 receives the control signal and generates a PWM voltage signal based on the received control signal as well as a charging control signal, a dimming control signal, optionally a deadband signal, and an analog dimming signal based on the PWM voltage signal in order to control the dimming level of the LED module 16 and the charging rate of the battery 14.

Figure 2A:
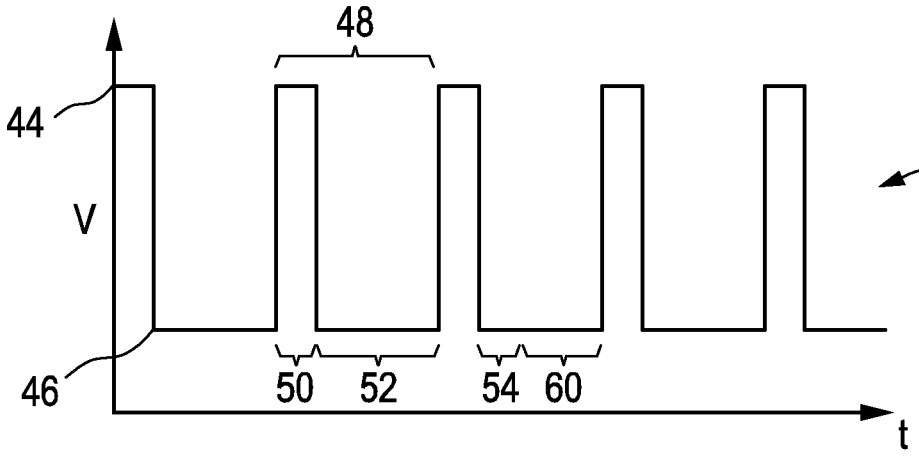
FIG. 2A shows schematically and exemplarily a duty cycle of 25% of a PWM voltage signal.
Figure 2B:
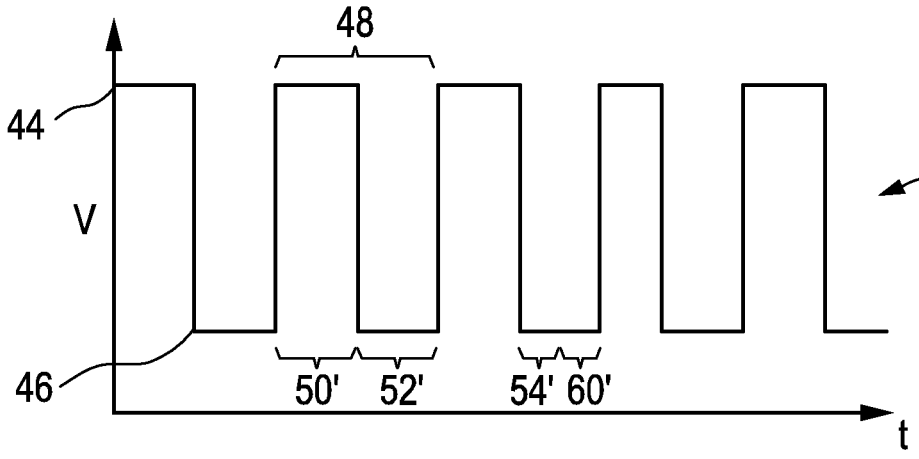
FIG. 2B shows schematically and exemplarily a duty cycle of 50% of the PWM voltage signal.
Figure 2C:
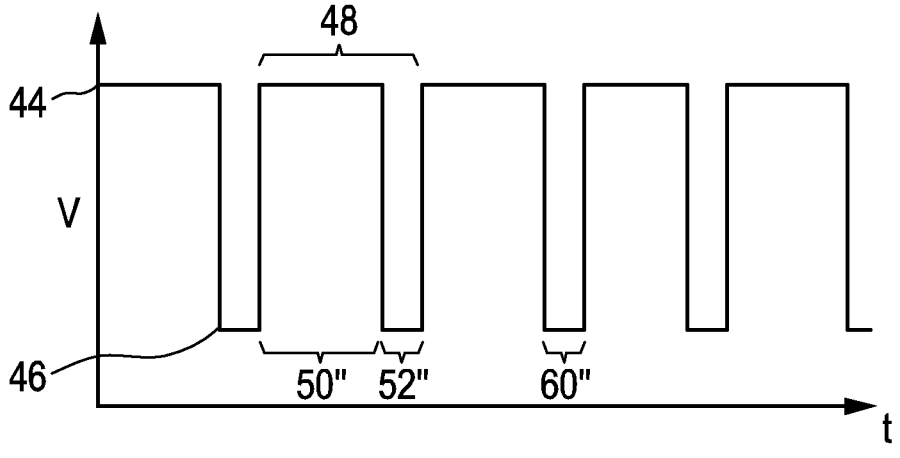
FIG. 2C shows schematically and exemplarily a duty cycle of 75% of the PWM voltage signal.

FIGS. 2A, 2B, and 2C show three PWM voltage signals 42, 42', and 42" and their corresponding duty cycles. The graphs show time t on the horizontal axis and voltage V on the vertical axis. The PWM voltage signals 42, 42', 42" have a high voltage amplitude 44 corresponding to an on state and a low voltage amplitude 46 corresponding to an off state. The on state corresponds to a voltage amplitude of 12 V in this embodiment. In other embodiments the voltage amplitude of the on state can also for example be a voltage amplitude above 5 V, such as 6 V or 10 V. The off state corresponds to a voltage amplitude of 0 V in this embodiment. For a constant frequency of the PWM voltage signal a cycle 48 extends over a predetermined time interval and is then repeated.

In FIG. 2A the PWM voltage signal 42 has a duty cycle of 25%. This means that an on period 50 lasts 25% of the cycle 48 while an off period 52 lasts 75% of the cycle 48.

In this embodiment a deadband period 54 is provided by the deadband controller 40 during which the battery 14 is not charged. Therefore the battery switching unit 26 is not switched in position for closing the circuit for charging the battery 14 during the deadband period 54. In the deadband period 54 neither the battery switching unit 26 nor the LED module switching unit 32 is switched in order to connect the battery 14 or LED module 16 with the common 30 or common 36. Varying the deadband period 54 allows to control the charging rate of the battery 14. The deadband period 54 can be adjusted between 0% to 100% of the off period 52 of the PWM voltage signal 42. In this embodiment the deadband period 54 is between the on period 50 and a charging period 60 of the off period 52. The deadband period can also be between a charging period and the on period or between two charging periods (not shown). In this embodiment the deadband period 54 is adjusted to ⅓ of the off period 52 of the PWM voltage signal 42, corresponding to 25% of the cycle 48. Therefore the battery 14 is charged during 50% of the cycle 48, i.e. charging period 60 lasts 50% of the cycle 48. As the cycle 48 is repeated, this also corresponds to 50% of the time in which the LED driver 12 is in operation.

In FIG. 2B the PWM voltage signal 42' has a duty cycle of 50%. The on period 50' lasts 50% of the cycle 48 while the off period 52' lasts also 50% of the cycle 48. The deadband period 54' is in this case adjusted to 50% of the off period 52', corresponding to 25% of the cycle 48. Therefore the battery is charged 25% of the cycle 48, i.e. charging period 60' lasts 25% of the cycle 48.

In FIG. 2C the PWM voltage signal 42" has a duty cycle of 75%. The on period 50" lasts 75% of the cycle 48 while the off period 52" lasts 25% of the cycle 48. The deadband period is in this case adjusted to 0% of the off period 52". Therefore the battery 14 is charged 25% of the cycle 48, i.e. charging period 60" lasts 25% of the cycle 48.

Figure 3:
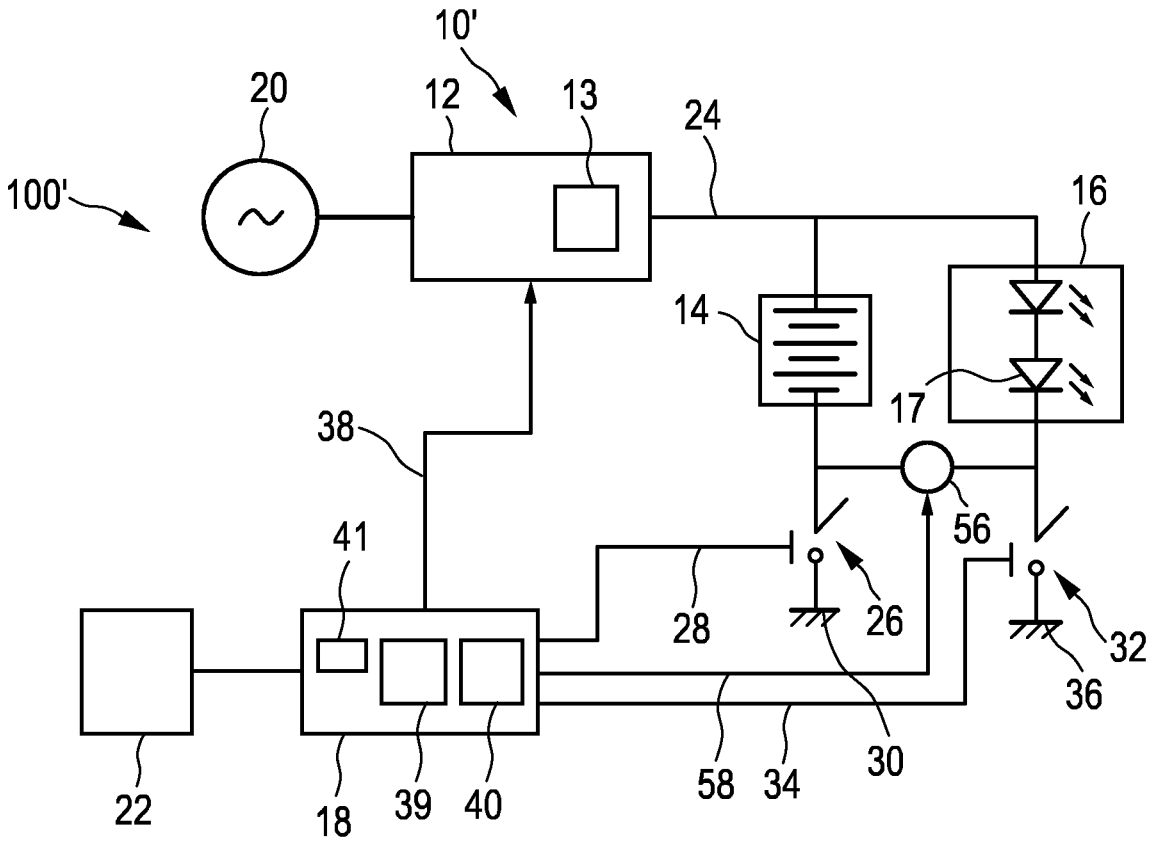
FIG. 3 shows schematically and exemplarily a second embodiment of the functional device in form of a lighting device in a second embodiment of the functional system in form of a lighting system.

FIG. 3 shows schematically and exemplarily a second embodiment of the functional device in form of a lighting device 10' in a second embodiment of the functional system in form of a lighting system 100'. The lighting device 10' is similar to the lighting device 10 according to the first embodiment presented in FIG. 1. The lighting device 10' in addition to the components of the lighting device 10 comprises an additional current source 56 and wire 58.

The lighting device 10' is configured to operate in IPWM mode. The additional current source 56 is arranged between the battery 14 and the LED module 16. The additional current source 56 is controlled based on a current source control signal which is based on the PWM voltage signal and provided via wire 58. In other embodiments the additional current source 56 can also be controlled based on the current source control signal provided wirelessly from the control unit 18. The current source control signal controls the additional current source 56 such that the additional current source 56 is connected to common during on periods of the PWM voltage signal and that the current source 56 controls a level of analog current provided to the LED module 16 during off periods of the PWM voltage signal.

During on periods of the PWM voltage signal, the current provided by the LED driver 12 is superimposed on the analog current and the currents are provided to the LED module 16 from the LED driver 12.

During a failure of the AC current source 20, DR or DSM time, the switching units 26 and 32 are open and the additional current source 56 controls the current provided from the battery 14 to the LED module 16. In this case the battery 14 is not provided with current from the LED driver 12, as the LED driver 12 is not in operation and the battery 14 provides a constant current to the LED module 16 based on a drive voltage provided by the additional current source 56 arranged between the battery 14 and LED module 16 during the off periods of the PWM voltage signal, i.e. during charging periods and deadband periods. However, no charging occurs during charging periods, as the LED driver 12 is not in operation. Operating the lighting device 10' in IPWM mode allows better color and light intensity control and thus efficient light intensity as the control of the current flow is improved.

In other embodiments IPWM operation of the functional device can be easily allowed by adding an additional current source in between the electrical energy storage unit and the functional unit during off periods of the PWM voltage signal (not shown).

The battery 14 is charged during off periods of the PWM voltage signal if the LED driver 12 is in operation.

Figure 4:
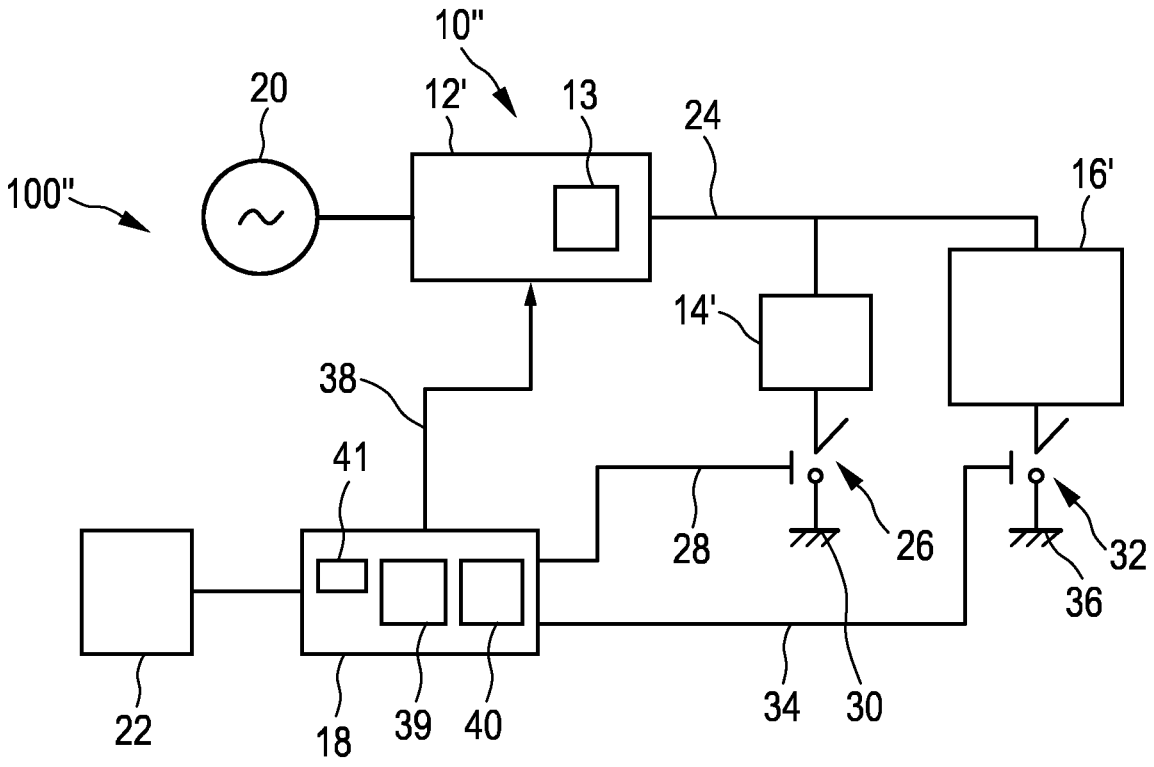
FIG. 4 shows schematically and exemplarily a third embodiment of the functional device in form of a heating device in a third embodiment of the functional system in form of a heating system.

FIG. 4 shows schematically and exemplarily a third embodiment of the functional device in form of a heating device 10" in a third embodiment of the functional system in form of a heating system 100". The heating system 100" has similar components as the lighting system 100. In contrast to the lighting system 100 the LED driver 12 is replaced by a heating element driver 12', the battery 14 is replaced by a capacitor module 14' comprising capacitors and the LED module 16 is replaced by a heating element 16'.

The heating element driver 12' provides a constant current to the heating element 16' by varying a drive voltage.

The capacitor module 14' stores electrical energy provided by current.

The heating element 16' increases its temperature when it is provided with current and hence allows to increase the temperature of its surrounding.

The control unit 18 controls a value of constant current provided by the heating element driver 12' via wire 38 by providing control signals to the heating element driver 12'. The control unit 18 furthermore controls the flow of current from the heating element driver 12' to the heating element 16' and the capacitor module 14'. Therefore the control unit 18 generates a PWM voltage signal as well as a charging control signal and a heating module control signal based on the PWM voltage signal that switch the switching units 26 and 32 such that current is provided to the capacitor module 14' in order to charge the capacitor module 14' during off periods of the PWM voltage signal and such that current is provided to the heating element 16' and no current is provided to the capacitor module 14' during on periods of the PWM voltage signal.

Hence the heating system 100" allows to efficiently use the constant current provided by the heating element driver 12'.

The control unit 18 can be provided with a control signal from BMS 22. The control signal can determine a duty cycle of the PWM voltage signal and furthermore comprise a value for the constant current that the heating element driver 12' provides.

The heating system 100" can be efficiently integrated in a larger AC grid. The AC source 20 can be part of a larger AC grid, such as a regional AC grid. The heating system 100" can make use of DR and DSM in the AC grid, as the capacitor module 14' can be used to temporarily store electrical energy provided by current during periods of high current availability in the AC grid. The high current availability can be indicated by a low price for electrical energy, e.g., on daytime when electrical energy is acquired with solar panels and a lower amount of electrical energy is required by users of the AC grid. The electrical energy stored by the capacitor module 14' can be provided to unit of the heating device 10" during periods of high electrical energy demand in the AC grid, e.g., indicated by a high price for electrical energy. This allows cost and revenue benefits using the heating device 10" and the heating system 100". Other embodiments of the functional device and functional system can also make use of DR and DSM.

Figure 5:
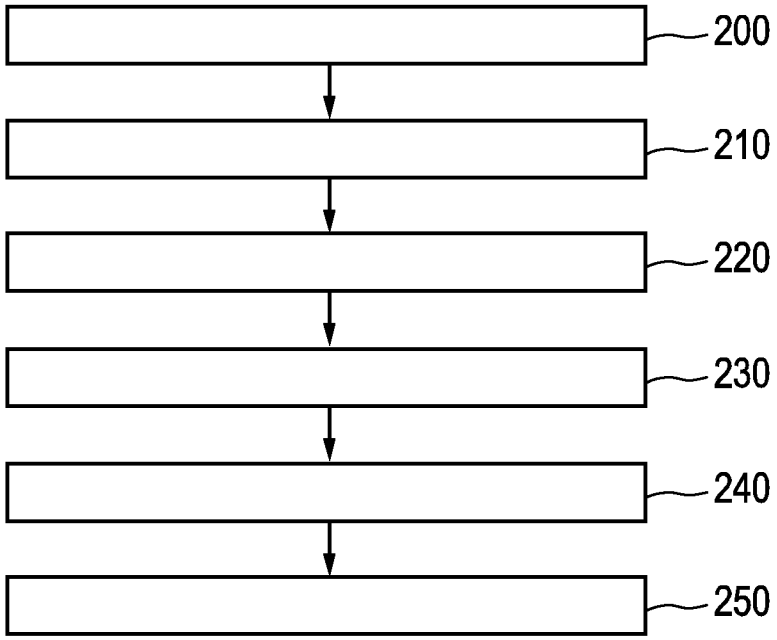
FIG. 5 shows an embodiment of a method for operating a functional device.

FIG. 5 shows an embodiment of a method for operating a functional device. The method allows to operate a functional device that can for example be a lighting device, a heating device, an actuation device, an audio amplifier device, or any other functional device operating based on current provided by a constant current driver. The actuation device can for example be a piezoelectric actuator, electromagnetic actuator, a DC electric motor device or any other actuation device.

In this embodiment the functional device is a lighting device. Hence the method operates a lighting device. The lighting device comprises an LED driver, an LED module, a battery and a control unit. The LED driver provides a constant current by varying a drive voltage. The battery stores electrical energy provided by current. The LED module has 4 LEDs that can provide light when they are provided with a constant current. The LED module can be provided with current from the LED driver, the battery or the LED driver and the battery. The control unit controls a flow of the current to and from the battery and to the LED module. The control unit can provide a PWM voltage signal for controlling the flow of the current.

In step 200 a PWM voltage signal is provided for switching the LED driver in order to control the flow of current.

In step 210 the flow of current is controlled such that current is provided to the battery in order to charge the battery during off periods of the PWM voltage signal and such that current is provided to the LED module and no current is provided to the battery during on periods of the PWM voltage signal. The LED driver is switched such that the LED driver provides current either to the battery or the LED module based on the PWM voltage signal.

In step 220 a deadband period between on periods of the PWM voltage signal and charging periods of the off periods of the PWM voltage signal in which current is provided to the battery is regulated in order to control a charging rate of the battery.

In step 230 the LED driver is switched based on the PWM voltage signal in order to control a dimming of the LED module.

In step 240 current is provided from the electrical energy storage unit to the LED module during on periods of the PWM voltage signal.

In step 250 current is provided from the battery to the LED module during off periods of the PWM voltage signal.

The method can be performed in an IPWM mode. The steps 220 to 250 are optional and can be performed in any other order and in any combination of the optional steps 220 to 250. In particular steps 240 and 250 can be alternative steps of the method.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality.

A single unit, processor, or device may fulfill the functions of several items recited in the claims. The mere fact that certain measures are recited in mutually different dependent claims does not indicate that a combination of these measures cannot be used to advantage.

Operations like providing a PWM voltage signal for switching the constant current driver in order to control the flow of current, controlling the flow of current such that current is provided to the electrical energy storage unit in order to charge the electrical energy storage unit during at least part of off periods of the PWM voltage signal and such that current is provided to the functional unit and no current is provided to the electrical energy storage unit during on periods of the PWM voltage signal, switching the constant current driver such that the constant current driver provides current either to the electrical energy storage unit or the functional unit based on the PWM voltage signal, et cetera performed by one or several units or devices can be performed by any other number of units or devices. These operations and/or the method can be implemented as program code means of a computer program and/or as dedicated hardware.

A computer program may be stored/distributed on a suitable medium, such as an optical storage medium, or a solid-state medium, supplied together with or as part of other hardware, but may also be distributed in other forms, such as via the Internet, Ethernet, or other wired or wireless telecommunication systems.

Any reference signs in the claims should not be construed as limiting the scope.

The present invention relates to a functional device powered by a constant current driver. The device comprises constant current driver, electrical energy storage unit, functional unit, and control unit. The device is controlled by the control unit such that the constant current driver provides a constant current to the functional unit and the electrical energy storage unit in dependence of a PWM voltage signal. Current is provided to the electrical energy storage unit for charging the electrical energy storage unit during at least part of off periods of the PWM voltage signal. During on periods of the PWM voltage signal, current is provided to the functional unit and no current is provided to the electrical energy storage unit. This allows providing the device with a constant current driver with less idle periods and lower current supply.

The invention claimed is:

1. A functional device comprising:

a constant current driver configured for providing a constant current by varying a drive voltage, an electrical energy storage unit for storing electrical energy, a functional unit for performing a function and configured to receive the constant current from the constant current driver and the electrical energy storage unit, and a control unit for controlling a flow of the current to and from the electrical energy storage unit and to the functional unit, wherein the control unit is configured to provide a pulse width modulated voltage signal for controlling the flow of the current such that current is provided to the electrical energy storage unit in order to charge the electrical energy storage unit during at least a part of an off period of the pulse width modulated voltage signal and such that current is provided to the functional unit and no current is provided to the electrical energy storage unit during an on period of the pulse width modulated voltage signal;

wherein the control unit is configured for controlling the flow of current by switching the constant current driver such that the constant current driver provides current either to the electrical energy storage unit or the functional unit based on the pulse width modulated voltage signal; and wherein the control unit is configured to control a charging rate of the electrical energy storage unit by regulating a deadband period between the on period of the pulse width modulated voltage signal and a charging period of the off period of the pulse width modulated voltage signal in which current is provided to the electrical energy storage unit.

2. The device according to claim 1, wherein the functional unit comprises a light emitting diode and the constant current driver is a light emitting diode driver.

3. The device according to claim 2, wherein the control unit is configured for controlling a dimming of the light emitting diode by switching the light emitting diode driver based on the pulse width modulated voltage signal.

4. The device according to claim 3, wherein the electrical energy storage unit is configured to provide current to the functional unit during the on period of the pulse width modulated voltage signal.

5. The device according to claim 4, wherein the device is configured to operate in an intelligent pulse width modulated mode.

6. The device according to claim 5, wherein the light emitting diode driver is configured for providing a low output current.

7. The device according to claim 6, wherein the light emitting diode driver is configured to provide an output voltage between 27 V and 54 V.

8. The device according to claim 7, wherein the control unit is configured for controlling a value of constant current provided by the light emitting diode driver.

9. A functional system comprising the device according to claim 1 and a current source.

10. A method for operating the functional device according to claim 1 comprising the steps:

providing a pulse width modulated voltage signal for switching the constant current driver in order to control the flow of current, controlling the flow of current such that current is provided to the electrical energy storage unit in order to charge the electrical energy storage unit during at least part of an off period of the pulse width modulated voltage signal and such that current is provided to the functional unit and no current is provided to the electrical energy storage unit during an on period of the pulse width modulated voltage signal;

wherein the flow of current is controlled by switching the constant current driver such that the constant current driver provides current either to the electrical energy storage unit or the functional unit based on the pulse width modulated voltage signal; and wherein the control unit is configured to control a charging rate of the electrical energy storage unit by regulating a deadband period between the on period of the pulse width modulated voltage signal and a charging period of the off period of the pulse width modulated voltage signal in which current is provided to the electrical energy storage unit.

11. A computer program for operating the functional device according to claim 1, wherein the computer program comprises program code means for causing a processor to carry out the method of claim 10, when the computer program is run on the processor.

12. A non-transitory computer-readable medium having stored the computer program of claim 11 when executed by one or more processors cause the one or more processors to carry out the method of claim 10.

* * * * *